US005400726A

United States Patent [19]

Dumons

[11] Patent Number: 5,400,726

[45] Date of Patent: Mar. 28, 1995

[54] METHOD OF TREATING RUBBISH OR WASTE AND IMPROVED PRESS FOR IMPLEMENTING IT

[76] Inventor: Pierre Dumons, 77, Allée de Brienne, 31000 Toulouse, France

[21] Appl. No.: 75,456

[22] PCT Filed: Nov. 8, 1993

[86] PCT No.: PCT/FR91/01016

§ 371 Date: Jun. 18, 1993

§ 102(e) Date: Jun. 18, 1993

[87] PCT Pub. No.: WO92/11132

PCT Pub. Date: Jul. 9, 1992

[30] Foreign Application Priority Data

Dec. 21, 1990 [FR] France ..... 90.16589

[51] Int. Cl.[6] ..... F23G 5/00

[52] U.S. Cl. ..... 110/346; 100/37; 100/42; 100/99; 100/102; 100/110; 110/223; 110/233; 110/234

[58] Field of Search ..... 110/233, 234, 223, 346; 100/42, 37, 99, 102, 110

[56] References Cited

U.S. PATENT DOCUMENTS 2,697,979 12/1954 Mac Murray .
4,201,129 5/1980 Matthys ..... 110/223 X
4,208,188 6/1980 Dick, Jr. .
4,603,909 8/1986 Le Jeune .
4,650,546 3/1987 Le Jeune ..... 110/223 X
5,001,975 3/1991 Finden ..... 100/42 X

FOREIGN PATENT DOCUMENTS 0016734 10/1980 European Pat. Off. .
2577167 8/1986 France .
2753926 3/1977 Germany .

*Primary Examiner*—Edward G. Favors
*Attorney, Agent, or Firm*—Shlesinger Arkwright & Garvey

[57] ABSTRACT

A method for treating waste involves (a) compressing the waste at a pressure of over 800 bars under conditions resulting in separation of the wet fermentable fraction and the solid combustible fraction; (b) exploiting each of these two fractions separately by means of, for the fermentable fraction, specific treatment to take advantage of its biomass nature and, for the combustible fraction, burning to produce energy. The method allows the waste to be exploited with high profitability. The invention also describes an improved press for compression in two successive phases: a precompression phase up to an intermediate pressure (200 to 300 bars) and final compression up to a final pressure of over 800 bars.

20 Claims, 6 Drawing Sheets

METHOD OF TREATING RUBBISH OR WASTE AND IMPROVED PRESS FOR IMPLEMENTING IT

FIELD OF THE INVENTION

The invention concerns a method of treating rubbish or waste, particularly household rubbish collected directly or indirectly by the public authorities or similar industrial waste consisting of a mixture of combustible and fermentable materials. The invention extends to an improved press adapted for implementing the above-mentioned method.

BACKGROUND OF THE INVENTION

Nowadays it is usual to receive raw rubbish or waste in processing centres after a simple compacting operation which facilitates its transportation. It is already known, according to DE-OS-27 53 920, that in addition to this first compacting it is possible to carry out, in a compression chamber, multiple compressions using a plurality of pistons introduced into and then withdrawn from the compression chamber one after the other. Each of the pistons has a cross section less than that of the chamber and only partially compresses the rubbish situated in this chamber. In order to obtain correct pressing of the rubbish, it is necessary to multiply the number of pistons and to control their action over time so that all the rubbish situated in the chamber is compressed in turn. Such a device is costly and complex to use.

Generally, in waste processing centres, the inert materials such as metals, iron, etc, are extracted and the remaining rubbish is exploited, essentially by means of two types of technique.

A first type of exploitation consists of incinerating the rubbish or waste in order to recover heat energy used for producing steam under pressure (which can be used for urban heating, for local industrial consumption, for the requirements of public authorities, etc, or again for the production of electric power by means of turbine generator sets). However, such incineration as practised at present has several failings.

Firstly, the total exploitation yield is mediocre and, as far as the authorities are concerned, generally results in a relatively high financial charge because of the high depreciation of the investments compared with the modest actual recovery of heat energy. Moreover, the raw rubbish has to be processed immediately and the recovery yield is further reduced since deliveries of rubbish and periods of high energy needs do not coincide. In addition, the low profitability of this exploitation makes it necessary to limit costs, and incineration is currently carried out in grate furnaces: without superheaters it is not possible, with this type of equipment, to comply with the recent pollution standards laid down in the majority of industrialised countries, both with respect to the solid residues, which have to contain very little unburnt material and be non-polluting, and with regard to the gaseous effluent, which has to be clean (for example, for EC standards, must be capable of maintaining itself at a temperature of more than 850° C. for more than 2 seconds).

In addition, another method of exploiting rubbish consists of taking advantage of the biomass which it contains in order to produce, by fermentation, composts, organic manure or gases. However, the methods of exploitation of this type are ill-suited to the processing of the above-mentioned raw rubbish consisting of a mixture of fermentable materials and combustible materials, and this handicap increases each year in industrialised countries because of the great increase in the proportion of non-fermentable materials in rubbish.

Consequently, at the present time, there is no satisfactory solution making it possible to process raw rubbish or waste in a manner which both complies with the pollution standards relating to the effluent and to exploit these materials profitably.

OBJECTS AND SUMMARY OF THE INVENTION

The present invention provides a solution constituting considerable progress compared with the techniques which are currently used.

Thus one object of the invention is to indicate a method of treating rubbish or waste which allows a better exploitation thereof with good profitability for the equipment used and is compatible with compliance with anti-pollution standards.

The method according to the present invention applies after any extraction of inert materials and consists of:

subjecting the said rubbish or waste to compression up to a final pressure ($P_f$) greater than 800 bars under clean conditions and extracting from it a fermentable fraction in the form of moist pulp and separating a solid combustible fraction with a relative humidity of less than 20%; the said compression of the rubbish or waste being effected in two successive phases in a chamber provided, on the one hand, with orifices for extruding the fermentable fraction and, on the other hand, an outlet for the combustible fraction:

a preliminary compression phase carried out by means of a long-stroke piston moving in the chamber so as to exert a pressure ($P_i$) less than the final pressure ($P_f$) on all the materials situated in the chamber, a final compression phase, carried out by means of a piston with a shorter stroke moving in the chamber in the opposite direction to the first piston so as to exert the final pressure ($P_f$) on all the materials situated in the chamber, and exploiting thereafter each of these two fractions separately, on the one hand, with regard to the fermentable fraction, by means of specific treatments, known per se, taking advantage of its biomass nature for the purpose in particular of producing organic products or gases and, on the other hand, with regard to the combustible fraction, by combustion for the purpose of the production of energy, if appropriate after a storage period.

It was found that the compression operation at the very high pressures mentioned above, in particular between 900 and 1050 bars, made it possible to separate, with a yield of more than 95%, the fermentable materials from the rubbish, consisting mainly of biomass, and the combustible materials of low relative humidity, in particular between 6% and 12%. At the end of such a compression, these combustible materials are no longer cohesive and have a tendency to break up into particles of their own accord, which makes them particularly well suited for undergoing incineration (in particular in circulating fluidised-bed furnaces as indicated below).

After this separation, the combustible materials are incinerated under optimum yield conditions, since the considerable energy losses to which the known methods are subject are eliminated, losses originating from energy consumption caused by the dehumidification of the rubbish and by the destruction of the biomass.

Because of its very low relative humidity and the absence of biomass, the combustible fraction collected at the end of the compression operation lends itself to profitable incineration in furnaces of the circulating fluidised bed type, known per se, under conditions which comply with the standards relating to combustion effluents. These furnaces, associated with steam-generating boilers, thus make it possible to produce superheated steam, with optimum use of the calorific value of the combustible fraction of the rubbish or waste.

In addition, this combustible fraction, free from moisture and biomass, can be stored for an indefinite period without any nuisance, in particular in heaps in areas in the open air, in order to be used by combustion during periods of very high energy demand.

Moreover, the fermentable fraction from which non-fermentable materials have been removed may, for its part, be treated under optimum conditions by means of known methods, in particular by biological seeding and fermentation for the purpose of producing composts, organic manures or gases able to provide heat energy.

Advantageously, the method according to the invention takes place in two successive phases, namely a preliminary compression and then a final compression.

The preliminary compression phase may in particular be carried out so as to achieve an intermediate pressure ($P_i$) of between 200 and 300 bars, and the final compression phase so as to achieve a final pressure ($P_f$) of between 900 and 1050 bars.

Carrying out the compression in two phases as defined above makes it possible to achieve, without difficulty, very high final pressures (of the order of 1000 bars) with equipment which is reliable and of modest cost; the long-stroke piston is specially designed to exert moderate pressures (normal pressures of 200 to 300 bars), whilst the piston with a shorter stroke is specially designed for very high pressures (of the order of 1000 bars): because of its short stroke, the cost of this piston is compatible with a modest total cost for the installation, whilst the other piston can be produced at low cost by means of current technology.

The present invention extends to an improved press, adapted for the effective implementation of the compression operation described above. This press has the following means, already known through French patent No. 2.577.167:

means for loading materials into a loading chamber having two opposing lateral openings, one referred to as the upstream opening and the other referred to as the downstream opening, an extrusion chamber situated in line with the loading chamber and opening out into the latter at its downstream opening, this extrusion chamber having extrusion orifices on its periphery and an outlet situated opposite the loading chamber, two coaxial pistons situated, in the retracted position, respectively on each side of the assembly formed by the loading chamber and extrusion chamber, the first piston being arranged so as to move between a retracted position in which its end is situated in the vicinity of the upstream opening of the loading chamber and an extreme deployed position in which it passes through the loading chamber and extrusion chamber with its end situated in the vicinity of the outlet from the latter, whilst the second piston is arranged so as to move between a retracted position situated so as to be withdrawn with respect to the extrusion chamber in order to leave clear the outlet from the latter, and an extreme deployed position, hydraulic means for operating the pistons in a deployment movement directed respectively towards the loading chamber or towards the extrusion chamber, and in an opposite retraction movement.

The press according to the present invention is characterised in that:

the second piston, with a shorter stroke than that of the first piston, is adapted so as to be able to exert pressures greater than those of the first piston, the second piston is arranged so that, in its extreme deployed position, it enters the extrusion chamber over a predetermined length of the latter in order to provide final compression of the materials, mechanical locking means situated upstream of the loading chamber are associated with the first piston in order to be able to prevent its withdrawal from an intermediate deployed position in which it passes through the loading chamber and partially enters the extrusion chamber.

Thus, in the press according to the invention, the two pistons are specially designed to fulfil different specific functions, namely: for the first piston, a function consisting of loading the extrusion chamber with shearing at the inlet to the latter, then a function consisting of the preliminary compression of the materials to a moderate intermediate pressure $P_i$ (notably of the order of 250 bars), and finally a function consisting of the ejection of the compressed solid fraction at the end of the cycle; for the second piston, a function consisting of closing off the extrusion chamber and a function consisting of the final compression from the intermediate pressure up to a very high pressure (notably of the order of 1000 bars). The migration and extrusion of the liquid or semi-liquid fraction begin during the preliminary compression phase; the final compression phase which follows provides a remarkably efficacious extraction of this fraction (fermentable materials) until separation yields of more than 95% and a relative humidity of the remaining solid materials (combustible fraction) of less than 12% are achieved.

Before the operation of the second piston, the first piston is locked mechanically so that the reaction forces are borne by mechanical components rather than by the hydraulic components of this piston. It is thus possible to exert the very high final pressures mentioned above on the materials without the hydraulic facilities of the first piston being subject to the rigorous technical requirements which pressures of this order demand.

According to a preferred embodiment, these mechanical locking means comprise:

at least one gripper with two jaws situated at the periphery of the first piston upstream of the loading chamber, a fixed stop serving as a longitudinal support for the gripper jaws, a shoulder provided on the circumference of the first piston and arranged so as to come opposite the jaws when this piston reaches its intermediate deployed position, means for operating the gripper jaws, adapted to provide their opening to a position which is withdrawn with respect to the circumference of the said piston or to allow their closure behind the shoulder on the piston.

According to another characteristic of the invention, the press advantageously comprises control means adapted for determining the following operating cycle, from an initial position in which the pistons are in the retracted position and the gripper jaws in the open position:

partial deployment of the second piston until the outlet from the extrusion chamber is closed off, with the materials loaded, deployment of the first piston first of all in the loading chamber so as to push the mass contained in the latter towards the extrusion chamber, and then in the said extrusion chamber in order to provide the preliminary compression phase, stoppage of the first piston and closure of the gripper jaws when the pressure reaches the intermediate value ($P_i$), deployment of the second piston in the extrusion chamber until the final pressure ($P_f$) is reached for the purpose of providing the final compression phase, withdrawal of the second piston to its retracted position for the purpose of leaving clear the outlet from the extrusion chamber, deployment of the first piston to its extreme deployed position in order to eject the compressed solid mass.

Other characteristics, aims and advantages of the invention will emerge from the following description with reference to the accompany drawings, which illustrate the method of the invention and present, by way of non-limitative example, an embodiment of an improved press for implementing it; in these drawings, which form an integral part of the present description:

DETAILED DESCRIPTION OF THE INVENTION

Figure 1:
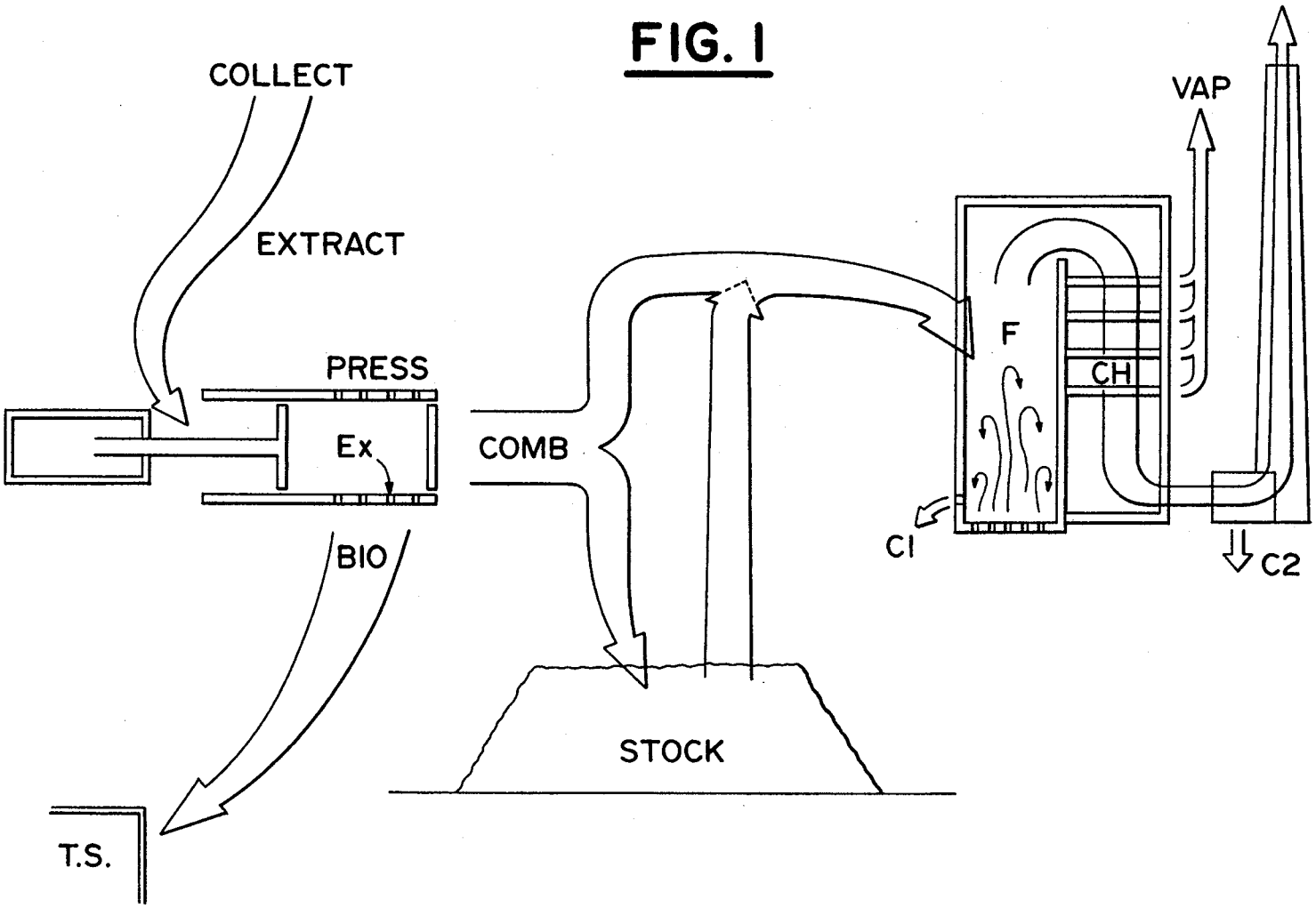
FIG. 1 is a diagram illustrating the method of the invention.
Figure 2:
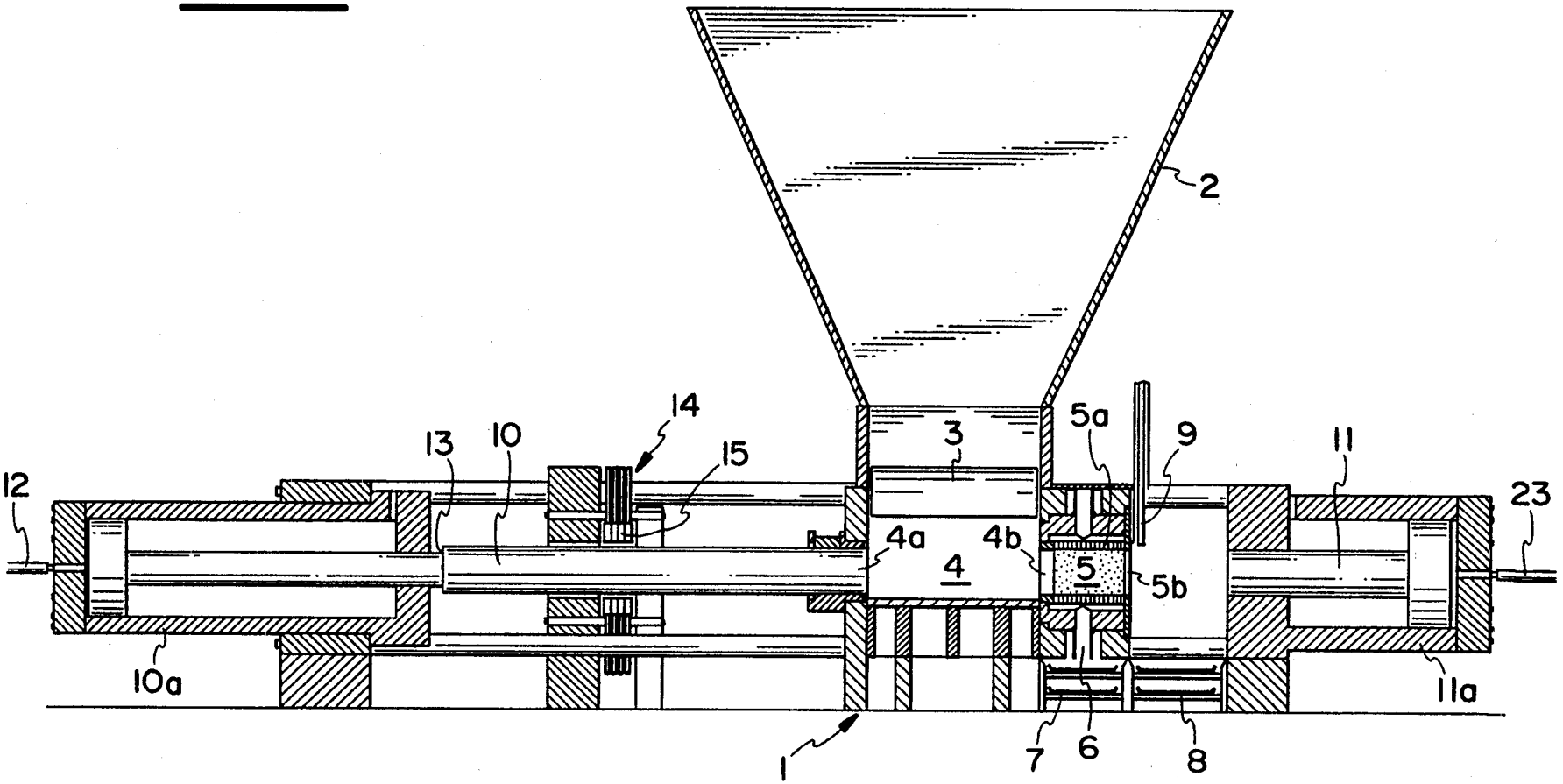
FIG. 2 is a vertical cross section of an improved press according to the invention.

FIG. 1 illustrates the implementation of the method of the invention, which applies in particular to the treatment of household rubbish but also to any similar waste including combustible materials and fermentable materials, notably certain industrial waste. These materials will be referred to hereinafter as "raw waste".

This raw waste is collected (COLLECT) and delivered to the processing centre at rates determined by the external environment, for example daily in the case of household rubbish.

In a conventional manner, when the waste contains inert materials such as metals, glass, etc, these are extracted by means of a preliminary processing (EXTRACT).

The waste is then subjected to a compression operation (PRESS) until it is subjected to a final pressure of around 1000 bars, which has the effect of separating:

a pulp consisting of moist, fermentable biomass (BIO), expelled under the effect of the high pressure through extrusion orifices in the press (designated by -Ex-), a dry residue (COMB) with a relative humidity of less than 12% (between 6 and 12%), which is broken up very small and consists of scraps of combustible material of very low cohesion.

The fermentable fraction may be despatched or kept on site to be treated within the required period in order to take advantage of its relatively pure biomass quality; it is subjected to specific treatments (T.S.) known per se, which become economically profitable because of the absence of any combustible solid materials, such as:

biological seeding and fermentation for making composts, pre-drying, biological seeding, maturation, drying and granulation for making organic manures, biological processing in a gas holder for manufacturing gaseous hydrocarbons for the purpose in particular of energy production by combustion.

The combustible fraction (COMB) may be either directly and immediately incinerated in a boiler furnace, or stored outside in thick layers which will keep indefinitely (STOCK) so that it can then be taken in again and incinerated during periods of high energy demand.

The characteristics of these combustible materials (very low humidity, absence of biomass, particulate form without cohesion) enable them to be incinerated under the best possible conditions in a boiler furnace of the circulating fluidised bed type (F) associated with a steam-generating boiler (CH). This type of furnace is know per se and is characterised in that the support for the mass to be burnt consists of a fluidised sand bed; it is also possible to attain (without superheaters), very high fume temperatures (above 850° C.) and to achieve clean combustion with excellent efficiency. The broken-up heavy ash ($C_1$) can be used as a filler material (road foundations, inert fillings, etc).

The high-temperature fumes passing through the steam-generating boiler (CH) are subjected to treatment in order to separate the flue dust ($C_2$) from them. The steam produced (VAP) may be used for any purpose depending on the economic usefulness and industrial or urban environment (direct use or production of electric power).

Thus the method of the invention leads to optimum exploitation of the rubbish or waste by virtue of thorough separation of two fractions of different natures, enabling their specific characteristics to be used to the best possible extent.

FIGS. 2, 3, 4, 5*a* and 5*b* show an improved press intended to provide this thorough separation of the two fractions.

This press rests on a support structure 1 and comprises conventional frame members (such as beams, etc) which hold the functional components in position with respect to each other (cf French patent No 2,577,167, already mentioned). A loading hopper 2 equipped with a conventional system of rams 3 compacts the waste and introduces it into a chamber 4, referred to as the loading chamber. This chamber, with a horizontal axis and cylindrical cross section, has two opposite lateral openings: an upstream opening 4a and a downstream opening 4b.

A chamber 5, referred to as the extrusion chamber, coaxial with the loading chamber 4, opens out into the latter at its downstream opening 4b; a cutting edge, situated in the plane of this opening, shears the material in the event of partial entry into the extrusion chamber.

The extrusion chamber 5 is defined by a perforated casing which has a plurality of extrusion orifices 5a on its periphery; these orifices have in particular a diameter of between 4 and 40 mm, notably around 10 mm, and open out into a collector 6, which delivers the liquid and semi-liquid extruded materials to a conveyor 7.

In addition, the extrusion chamber 5 has, opposite the loading chamber, an outlet 5b for the solid fraction, its diameter substantially equal to that of the said extrusion chamber. A conveyor 8 receives the solid material at the outlet and conveys it out of the press.

In addition, in the example, a guillotine 9 is situated at the outlet from the extrusion chamber; this guillotine, associated with operating means such as a vertical jack, may be caused to sweep the outlet plane of the said chamber for the purpose of cleaning the said outlet by friction and, if necessary, breaking up compact blocks.

The press also comprises two coaxial pistons 10 and 11 which, in the retracted state, are disposed on each side of the assembly formed by the loading chamber 4 and compression chamber 5; these pistons are guided in a conventional manner by bodies and sleeves such as 10a and 11a, and associated with hydraulic means (designated by 12 and 23) for the purpose of moving them in a sliding motion along the common horizontal axis of the two chambers 4 and 5.

Figure 11:
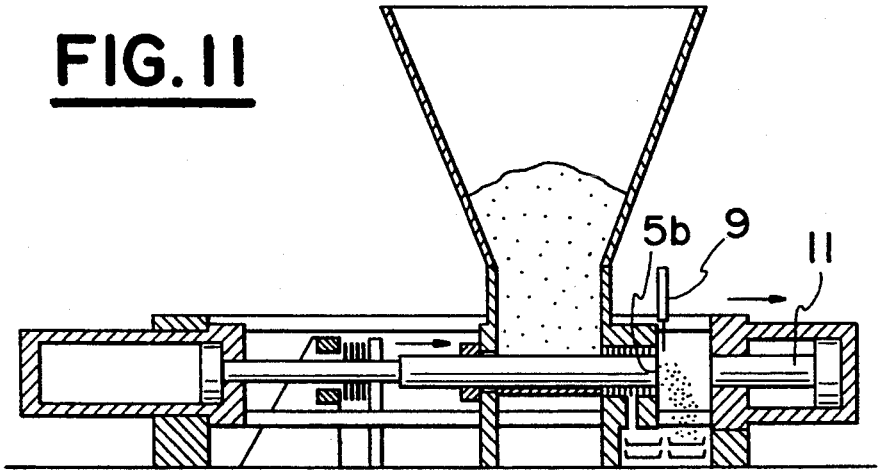

The first piston 10 is of the long-stroke type (of the order of 220 cm) capable of transmitting normal pressures of around 250 bars; it may be operated by hydraulic means 12 between an extreme retracted position in which its end is situated at the upstream opening of the loading chamber (FIG. 2) and an extreme deployed position in which its end is situated at the outlet from the extrusion chamber (FIG. 11).

This piston 10 has, on its circumference, a shoulder 13 defining a front section with a cross section larger than its rear section. This shoulder is arranged to interact with mechanical locking means 14 adapted so as to make it possible to prevent the retraction of the said piston from an intermediate deployment position in which this piston passes through the loading chamber and partially enters the extrusion chamber.

Figure 4:
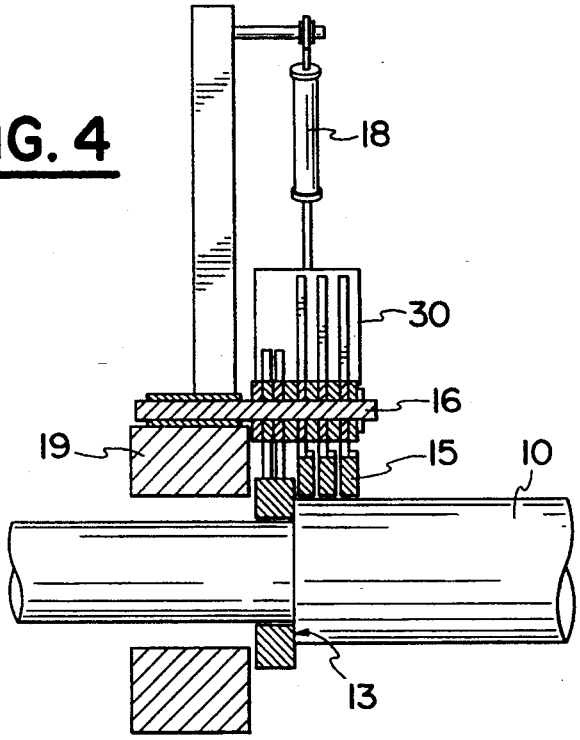
FIG. 4 is a detailed cross section of one of the components of the said press (mechanical locking means)
Figure 5A:
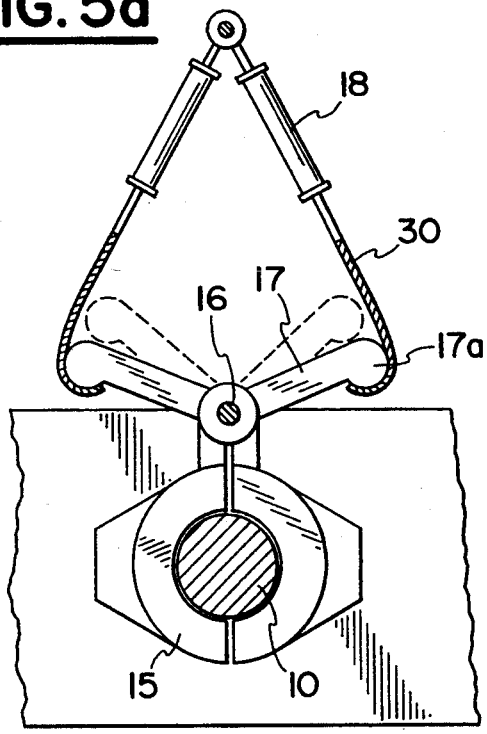
FIGS. 5*a* and 5*b* are detailed front views, showing the said locking means respectively in the closed position and in the open position.
Figure 5B:
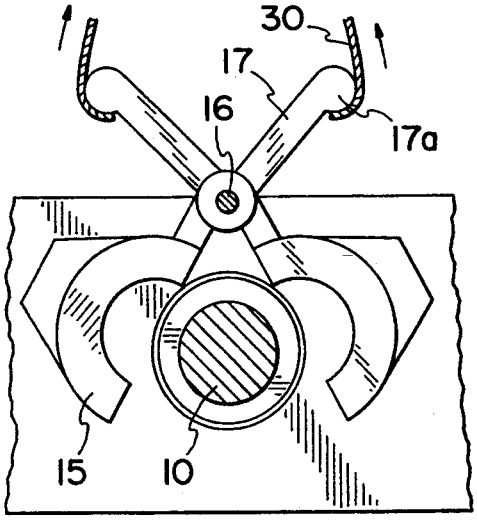

These locking means are shown in detail in FIGS. 4, 5a, 5b; they comprise a succession of gripper jaws such as 15, which are juxtaposed close to each other and are articulated about a fixed shaft 16. The two jaws on each gripper 15 are extended by arms 17, the rounded ends 17a of which come to be housed in supporting troughs formed at the base of two plates 30; these plates are attached to two operating jacks 18. In the deployed position of these jacks 18 (FIG. 5a), the jaws close under their own weight towards the piston 10, whilst, in the retracted position of these jacks (FIG. 5b), the said jaws are raised and open, that is to say withdrawn with respect to the cylindrical surface of the piston 10.

A fixed stop 19 is situated at the rear of the jaws 15 to serve as a longitudinal support for them for the purpose of assuming the reaction forces transmitted by the jaws. This annular-shaped stop is arranged so as to allow the piston 10 to pass in its largest section, whilst serving as a longitudinal support for the closed jaws; the latter jaws (jaws situated in contact with the said stop) are subjected to high shear and bending stresses and are provided with an appropriate thickness greater than that of the others.

The shoulder 13 is positioned along the piston 10 so that it comes opposite the jaws 15 when the piston 10, having entered the extrusion chamber 5, is situated between two predetermined deployment positions (entry into the extrusion chamber over a predetermined range of depths).

Figure 3:
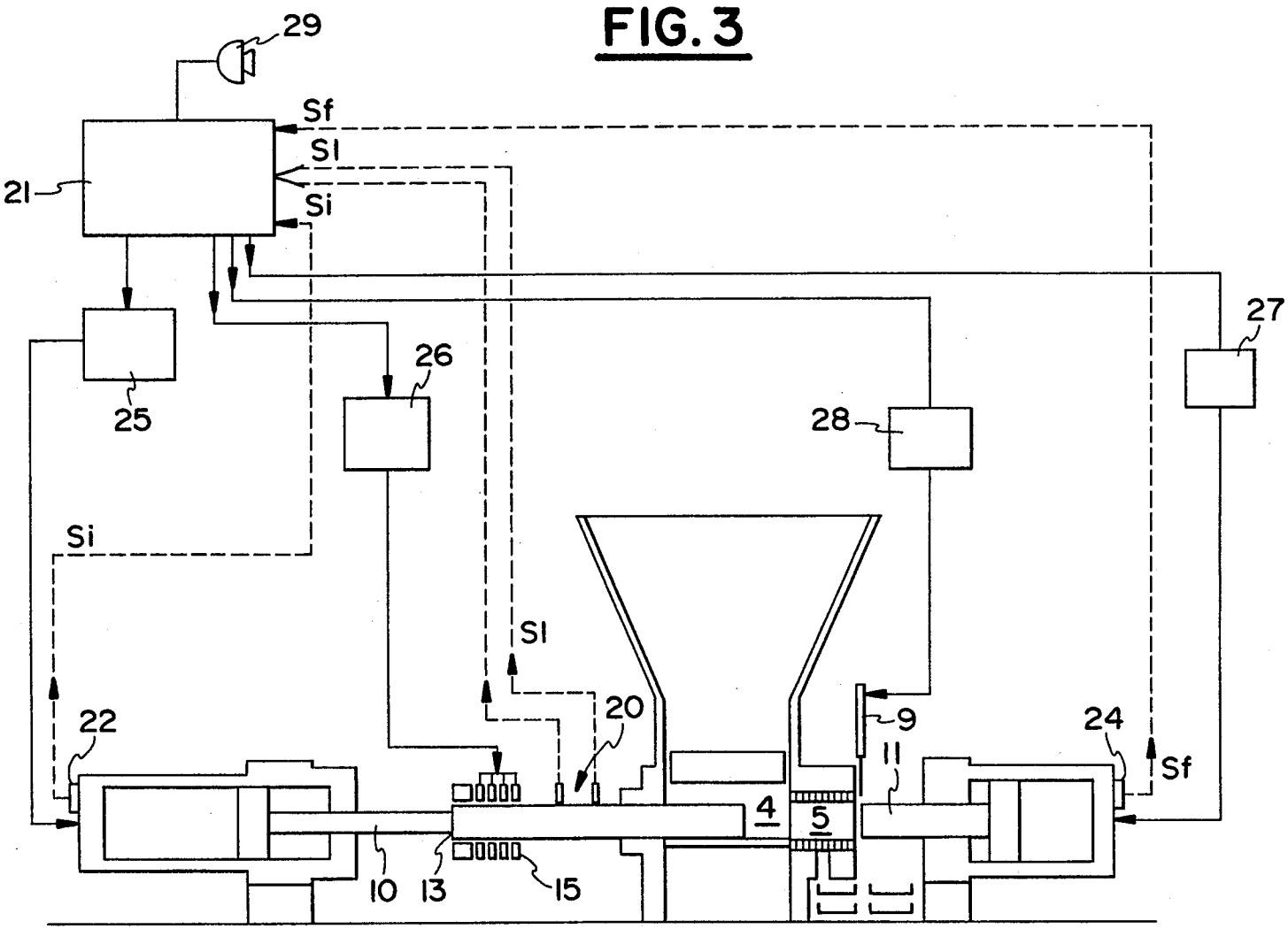
FIG. 3 is a diagrammatic view showing the said press and its control means and detection means.

As is shown diagrammatically in FIG. 3, longitudinal position detection means 20 are associated with the piston 10, delivering a position signal $S_1$ when the said piston is situated between these two deployment positions (which correspond to the shoulder 3 passing at the level of the locking jaws 14). This position signal is delivered to the control means designated by 21, adapted for determining the press operating cycle, which will be described below.

In addition, pressure detection means, designated by 22, are associated with this first piston 10 (and more precisely with its hydraulic means 12) for the purpose of delivering a pressure signal $S_i$ to the control means 21 when the pressure applied to the said first piston reaches a predetermined intermediate value $P_i$ (of the order of 200 to 300 bars, for example 250 bars); this signal is intended to trigger a command stopping the said piston when the latter is subjected to this intermediate pressure.

Moreover, the second piston 11 is of the reduced-stroke type (of the order of 50 to 60 cm) capable of transmitting very high pressures, of the order of 1000 bars. This piston and its hydraulic means require special manufacture, but its reduced stroke make their cost compatible with good financial profitability of the press.

This second piston 11 may be operated by the hydraulic means 23 between an extreme retracted position in which its end is situated so as to be withdrawn with respect to the extrusion chamber 5, in order to leave clear the outlet from the latter (FIG. 2), and an extreme deployed position in which it enters the extrusion chamber over a predetermined length (FIG. 10) in order to provide the final compression of the materials at the final pressure $P_f$ (of the order of 900 to 1050 bars, for example 1000 bars).

As is shown diagrammatically in FIG. 3, pressure detection means, designated by 24, adapted for delivering a stop signal $S_f$ to the control means 21 when the pressure applied to the second piston reaches the final value $P_f$, are associated with the said second piston 11 (and more precisely with its hydraulic means).

The control means 21 in the example consist of a programmable automatic controller which is programmed to send control signals to distribution boxes 25, 26, 27 and 28, for the purpose of sequencing the operating cycle, by appropriate powering of the hydraulic means for operating the first piston 10, the jacks for operating the locking jaws 15, the hydraulic means for operating the second piston 11 and the jack for operating the guillotine 9.

The automatic controller 21 is in particular programmed to determine the operating cycle illustrated in FIGS. 6 to 11 and described below.

Figure 6:
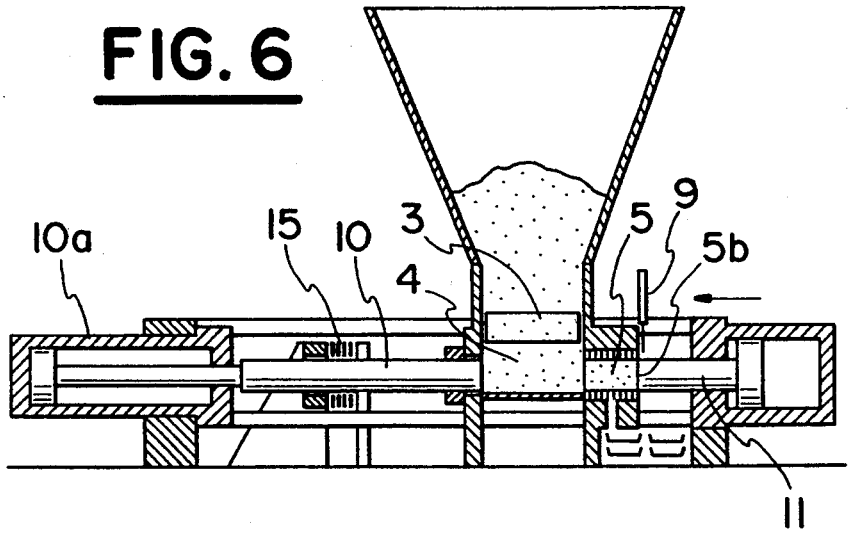
FIGS. 6, 7, 8, 9, 10 and 11 are diagrammatic views showing the main steps of the press operating cycle.

The press is assumed to be in the following initial position: first piston 10 and second piston 11 in the fully retracted state, locking jaws 15 open, guillotine 9 raised. Firstly, the second piston 11 is partially deployed until it closes off the outlet 5b from the extrusion chamber (FIG. 6). The hopper 2 being loaded, the raw materials are compressed in the loading chamber 4 by the system of rams 3.

Figure 7:
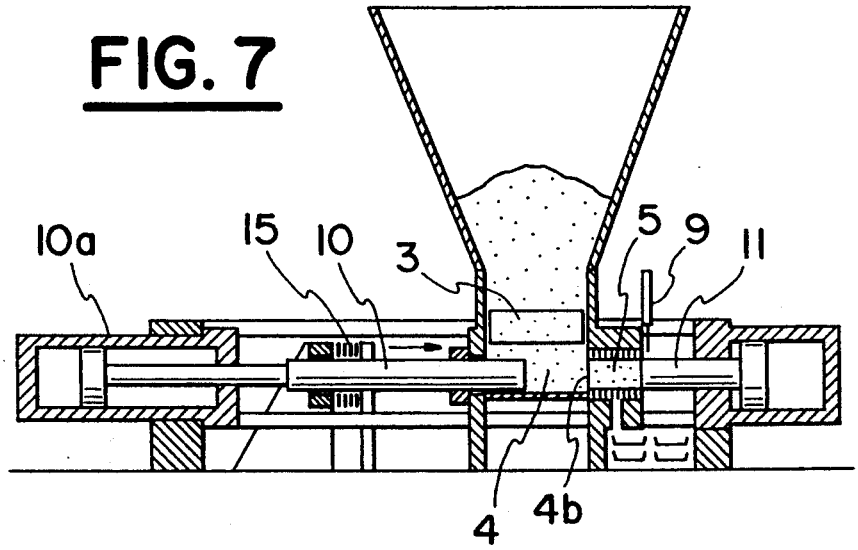

The first piston 10 is deployed in the loading chamber 4 and pushes the mass contained in the latter towards the extrusion chamber (FIG. 7).

Figure 8:
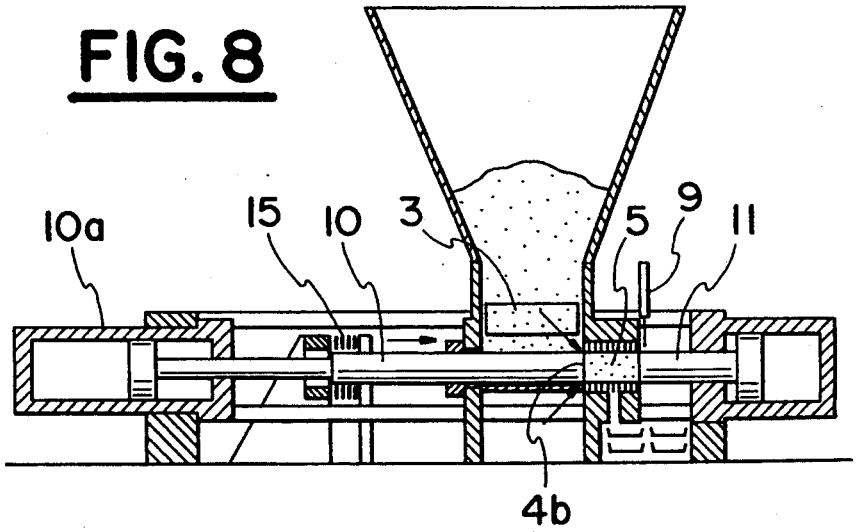

The first piston 10 continues its forward movement and its end arrives at the level of the downstream opening 4b; the materials are sheared by the cutting edge situated around this opening (FIG. 8).

Figure 9:
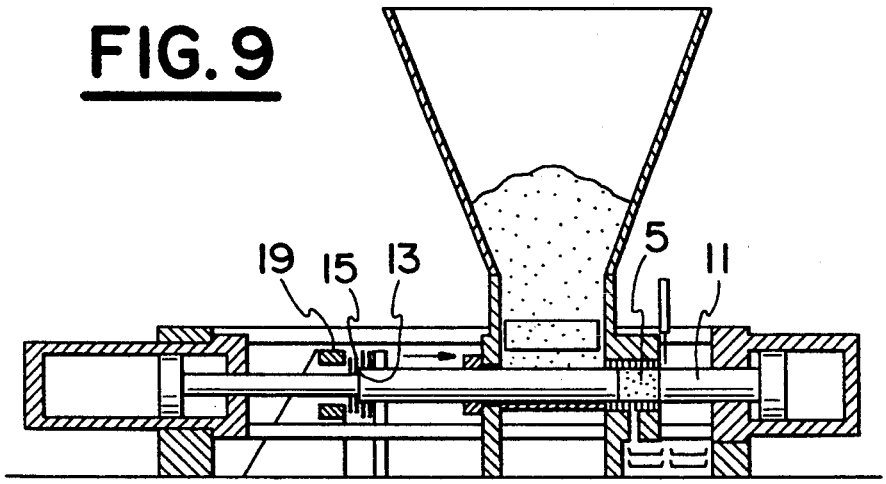

The first piston 10 enters the extrusion chamber 5 and provides a preliminary compression phase of the materials between its end and that of the second piston 11, which is closing off the outlet 5b from the extrusion chamber. When the first piston arrives between the two above-mentioned deployment positions, the detection means 20 deliver the position signal $S_1$ to the control means 21; the shoulder 13 is then situated opposite the locking jaws 15; in the absence of any untoward event and for materials of normal consistency, the intermediate pressure $P_i$ is exerted on the piston 10 when the latter is between these two deployment positions, and the pressure signal $S_i$ is delivered by the detection means 22. When the pressure signal $S_i$ and position signal $S_1$ are present, the automatic controller brings about the stoppage of the piston 10 and the deployment of the jacks 18, which release the locking jaws 15 and enable them to close again (FIG. 9). The withdrawal of the first piston 10 is then blocked by the jaws, which have closed behind the shoulder 13 (the reaction being transmitted to the fixed stop 19).

Figure 10:
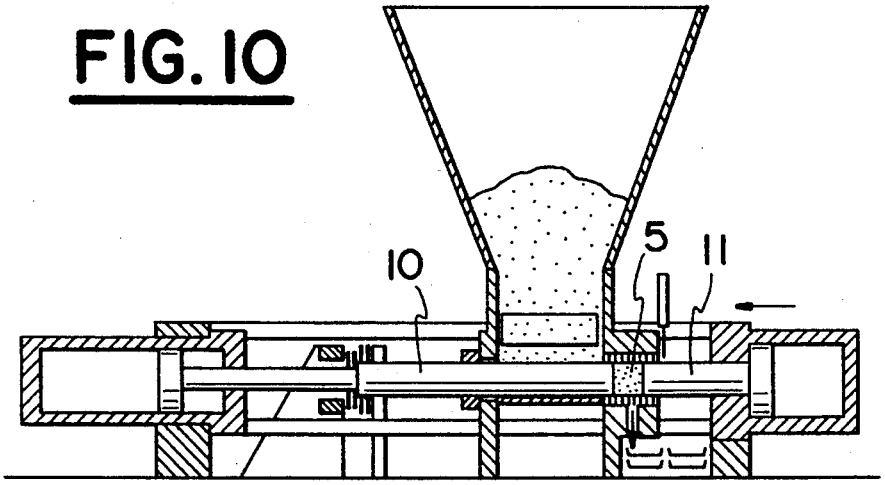

The second piston 11 is then deployed in the extrusion chamber 5 for the purpose of providing the final compression phase (FIG. 10). When the final pressure $P_f$ is reached, a stop signal $S_f$ is delivered and the automatic controller 21 brings about, on the one hand, the stoppage of the second piston and, on the other hand, the holding of the said second piston in its stopped position for a predetermined period, for example of around 2 seconds. The expulsion of the liquid and semi-liquid materials thus becomes final, without any risk of suction of these materials towards the solid mass through the effect of relaxation phenomena in this mass.

The withdrawal of the second piston 11 is then actuated as far as its retracted position for the purpose of leaving clear the outlet 5b from the extrusion chamber, and then the first piston 10 is caused to be fully deployed in order to eject the compressed solid mass (FIG. 11). The guillotine 9 may be operated during or after this ejection.

In addition, the automatic controller 21 is programmed to trigger an alarm 29 (FIG. 3) and stop the first piston 11 in the event of any untoward event during the preliminary compression phase determining the premature application of the intermediate pressure $P_i$ on the first piston (appearance of the pressure signal $S_i$ before the position signal $S_1$). An operator can thus examine the cause of this abnormality (jamming of an object, etc) and remedy it.

On the other hand, if the extrusion chamber 5 is insufficiently loaded or if the consistency of the materials is less than normal, the position signal $S_1$ disappears whilst the pressure signal $S_i$ has not appeared: the automatic controller 21 is programmed to bring about, in such case, a retraction of the first piston 10 when the position signal $S_1$ disappears, and then the start of a new operating cycle, until the position signal $S_1$ and pressure signal $S_i$ are obtained simultaneously. In this way unnecessary final compression phases (slow phases, consuming energy and generating higher wear) are avoided; in addition several outward and return motions of the first piston 10 produce successive preliminary compressions and relaxations of the materials and increase the efficacy of separation of the two fractions, combustible and fermentable.

What is claimed is:

1. Method of treating waste, after extraction of inert materials, comprising:

a) subjecting the waste to compression up to a final pressure greater than 800 bars and extracting from the waste a fermentable fraction in the form of moist pulp and separating a solid combustible fraction with a relative humidity of less than 20%; the compression of the waste being effected in two successive phases in a chamber provided with orifices for extruding the fermentable fraction and an outlet for the combustible fraction:

i) a preliminary compression phase carried out by means of a long-stroke piston moving in the chamber so as to exert a pressure less than the final pressure on all the materials situated in the chamber, ii) a final compression phase, carried out by means of a piston with a shorter stroke moving in the chamber in the opposite direction to the first piston so as to exert the final pressure on all the materials situated in the chamber, and b) exploiting thereafter each of these two fractions separately: with regard to the fermentable fraction, by means of treatments taking advantage of its biomass nature for the purpose of producing organic products and, with regard to the combustible fraction, by combustion for the purpose of the production of energy.

2. Method according to claim 1, wherein at the end of the preliminary compression phase, the long-stroke piston is stopped and it is mechanically locked to prevent its withdrawal, and then movement of the piston with a shorter stroke is actuated in order to effect the final compression phase.

3. Method according to claim 2, wherein the long-stroke piston is stopped and mechanically locked when the pressure applied to the said piston reaches a predetermined intermediate value less than the value of the final pressure.

4. Method according to claim 3, wherein the preliminary compression phase is carried out so as to achieve an intermediate pressure of between 200 and 300 bars, and the final compression phase is carried cut so as to achieve a final pressure of between 900 and 1050 bars, the combustible fraction having a relative humidity of between 6% and 12%.

5. Method according to claim 1, wherein the compression is carried out in a chamber having extrusion orifices with a diameter of between 4 and 40 mm and an outlet for the combustible fraction with a diameter approximately equal to that of the said chamber.

6. Method according to claim 1, wherein the combustion of the combustible fraction is carried out in a furnace of the circulating fluidised bed type.

7. Method according to claim 6, wherein the combustion of the combustible fraction is used to produce superheated steam, the circulating fluidised bed furnace being associated with a steam-generating boiler.

8. Method according to claim 1, wherein the waste is collected and delivered at rates imposed by the external environment, the compression of the waste is effected as deliveries occur, the combustible fraction is stored for the purpose of exploiting it by combustion during periods of energy demand, whilst the fermentable fraction is exploited within the periods required by the treatments to which it is subjected.

9. Method according to claim 8, wherein the combustible fraction is stored in the open air.

10. Press for the treatment of materials, comprising:

a) means provided for loading materials into a loading chamber having two opposed lateral openings, one being an upstream opening and the other being a downstream opening, b) an extrusion chamber situated in line with the loading chamber and opening out into the latter at its downstream opening, said extrusion chamber having extrusion orifices on its periphery and an outlet situated opposite the loading chamber, c) two coaxial pistons situated, in the retracted position, respectively on each side of the assembly formed by the loading chamber and extrusion chamber, a first one of said two coaxial pistons being arranged so as to move between a retracted position in which its end is situated in the vicinity of the upstream opening of the loading chamber and an extreme deployed position in which it passes through the loading chamber and extrusion chamber with its end situated in the vicinity of the outlet from the latter, the second piston of said two coaxial pistons being arranged so as to move between a retracted position situated so as to be withdrawn with respect to the extrusion chamber in order to leave clear the outlet from the latter, and an extreme deployed position, d) hydraulic means provided for operating the pistons in a deployment movement directed respectively towards the loading chamber or towards the extrusion chamber, and in an opposite retraction movement, e) the second piston, with a shorter stroke than that of the first piston being configured for exerting pressures greater than those of the first piston, f) the second piston is arranged so that, in its extreme deployed position, it enters the extrusion chamber over a predetermined length of the latter in order to provide final compression of the materials, and g) mechanical locking means situated upstream of the loading chamber and being associated with the first piston for preventing its withdrawal from an intermediate deployed position in which it passes through the loading chamber and partially enters the extrusion chamber.

11. Press according to claim 10, wherein the mechanical locking means comprises:

a) at least one gripper with two jaws situated at the periphery of the first piston upstream of the loading chamber, b) a fixed stop serving as a longitudinal support for the gripper jaws, c) a shoulder provided on the circumference of the first piston and arranged so as to come opposite the gripper jaws when the first piston reaches an intermediate deployed position, and d) means provided for operating the gripper jaws, the operating means opening the gripper jaws to a position which is withdrawn with respect to the circumference of the said piston and for allowing the gripper jaws closure behind the shoulder on the piston.

12. Press according to claim 11, wherein:

a) the locking means comprises a succession of juxtaposed gripper jaws, and b) pressure detection means is associated with the first piston for delivering a pressure signal when the pressure applied to the said first piston reaches a predetermined intermediate value, control means being provided to bring about the stoppage of the said first piston when the said pressure signal appears.

13. Press according to claim 11, wherein control means is provided, for determining the following operating cycle, from an initial position in which the pistons are in the retracted position and the gripper jaws are in the open position:

a) partial deployment of the second piston until the outlet from the extrusion chamber is closed off, b) with the materials loaded, deployment of the first piston first of all in the loading chamber so as to push the mass contained in the latter towards the extrusion chamber, and then in the said extrusion chamber in order to provide the preliminary compression phase, c) stoppage of the first piston and closure of the gripper jaws when the pressure has reached the intermediate value, d) deployment of the second piston in the extrusion chamber until the final pressure is reached for the purpose of providing a final compression phase, e) withdrawal of the second piston to its retracted position for the purpose of leaving clear the outlet from the extrusion chamber, and f) deployment of the first piston to its extreme deployed position in order to eject the compressed solid mass.

14. Press according to claim 13, wherein:

a) longitudinal position detection means is associated with the first piston for delivering a position signal when, after entering the extrusion chamber, the said first piston is situated between two predetermined deployment positions, and b) the control means is adapted for stopping the first piston and for bringing about the closure of the jaws when the pressure signal and the position signal are present, and for bringing about a retraction of the said first piston, and then the start of a new operating cycle if the pressure signal has not appeared when the position signal disappears.

15. Press according to claim 14, wherein the control means is adapted for triggering an alarm and the stoppage of the first piston if the pressure signal appears before the appearance of the position signal.

16. Press according to claim 13, wherein:

a) pressure detection means is associated with the second piston for delivering a stop signal when the pressure applied to the said second piston reaches a predetermined final value, and b) the control means is adapted for bringing about the stoppage of the second piston when the stop signal appears and for the holding of the said second piston in its stop position for a predetermined period.

17. Press according to claim 10, wherein a guillotine (9) is situated at the outlet from the extrusion chamber and an operating means is associated with the said guillotine for the purpose of causing said guillotine to sweep the outlet plane of the said chamber.

18. Press according to claim 10, wherein the first piston is adapted to exert on the materials a pressure of around 250 bars, and the second piston is adapted to exert a pressure of around 1000 bars.

19. A press for the treatment of materials, comprising:

a) a loading chamber having two spaced opposed openings, one said opening being an upstream opening and the other said opening being a downstream opening;

b) means provided for loading materials into said loading chamber;

c) an extrusion chamber disposed adjacent said loading chamber and opening into said loading chamber at said downstream opening thereof, said extrusion chamber having extrusion orifices, and said extrusion chamber having an outlet disposed opposite said loading chamber;

d) a pair of spaced apart coaxial pistons disposed, in respective retracted positions, respectively on each side of an assembly defined by said loading chamber and said extrusion chamber, a first one of said coaxial pistons being movable between a retracted position in which its end is located adjacent said upstream opening of said loading chamber and an extreme deployed position in which said first piston extends through said loading chamber and said extruding chamber with its end being disposed adjacent said outlet of said extrusion chamber;

e) said second one of said coaxial pistons being movable between a retracted position in which said second piston is withdrawn relative to said extrusion chamber for leaving said outlet of said extrusion chamber clear, and an extreme deployed position;

f) means provided for moving said pistons toward said loading chamber and toward said extrusion chamber, and for retracting said pistons;

g) said second piston having a shorter stroke than a stroke of said first piston, and said second piston being configured for exerting a pressure greater than a pressure exerted by said first piston;

h) said second piston being configured for entering said extrusion chamber when said second piston is in its extreme deployed position, said second piston moving over a predetermined length of said extrusion chamber when in said extreme deployed position for providing a final compression of materials therein; and, i) means associated with said first piston for locking said first piston, said locking means preventing withdrawal of said first piston from an intermediate deployed position in which said first piston passes through said loading chamber and partially enters said extrusion chamber.

20. A press for the treatment of materials as defined in claim 19, wherein:

a) said locking means includes at least one gripper for mechanically engaging said first piston.

* * * * *

UNITED STATES PATENT AND TRADEMARK OFFICE

CERTIFICATE OF CORRECTION

PATENT NO. : 5,400,726

DATED : March 28, 1995

INVENTOR(S) : Pierre Dumons

It is certified that error appears in the above-indentified patent and that said Letters Patent is hereby corrected as shown below:

ON THE TITLE PAGE:

After "[22] PCT Filed", please change "Nov. 8, 1993" to --Dec. 12, 1991--.

Signed and Sealed this

Thirteenth Day of June, 1995

*Attest:*

*Attesting Officer*

BRUCE LEHMAN

*Commissioner of Patents and Trademarks*